United States Patent [19]

Nicholson et al.

[11] 4,260,483

[45] Apr. 7, 1981

[54] BOTTLE CAP INSPECTING MACHINE

[75] Inventors: John G. Nicholson, New Rochelle, N.Y.; Ian P. Campbell, South Norwalk, Conn.

[73] Assignee: Zapata Industries, Inc., Frackville, Pa.

[21] Appl. No.: 874,649

[22] Filed: Feb. 2, 1978

[51] Int. Cl.[3] ..... B07C 5/34

[52] U.S. Cl. ..... 209/539; 209/560; 209/591; 209/598; 209/600; 209/644; 209/912; 209/928; 209/932; 209/936; 425/809

[58] Field of Search ..... 209/591, 928, 912, 598, 209/586, 644, 932, 559, 560, 539, 600, 552, 936, 906; 113/80 D, 80 DA; 425/809, 201, 215, 216; 264/268; 198/339, 612, 651, 480; 302/24, 31

[56] References Cited

U.S. PATENT DOCUMENTS

| | | | |
|---|---|---|---|
| 2,621,805 | 12/1952 | Young | 198/339 X |
| 2,829,756 | 4/1958 | Gercke et al. | 198/480 |
| 3,001,506 | 9/1961 | Ford | 425/809 X |
| 3,089,594 | 5/1963 | Early | 209/525 |
| 3,135,019 | 6/1964 | Aichele . | |
| 3,160,443 | 12/1964 | Harris et al. | 302/24 X |
| 3,318,137 | 5/1967 | Denlinger et al. | 209/598 X |
| 3,360,827 | 1/1968 | Aichele . | |
| 3,432,033 | 3/1969 | Everett | 209/560 |
| 3,702,133 | 11/1972 | Vibert et al. | 209/644 X |
| 3,724,655 | 4/1973 | Clark | 209/591 X |
| 3,746,163 | 7/1973 | Ochs et al. | 209/928 X |
| 3,938,643 | 2/1976 | Parker | 198/339 |

*Primary Examiner*—Robert J. Spar
*Assistant Examiner*—Edward M. Wacyra
*Attorney, Agent, or Firm*—Pennie & Edmonds

[57] ABSTRACT

In accordance with the present invention, methods and machinery are provided for automatically inspecting shaped, lined closures and rejecting those which fail to meet pre-established criteria for shape and seal. Specifically, shaped closures having concave interior portions and resilient sealing liners are supplied to an inspection station comprising one or more female inspection nests for receiving individual closures and one or more respective male inspection heads for insertion into the concave portions of respective closures. The inspection heads are provided with exterior shapes approximating the interiors of ideal closures so that penetration into the closure indicates the conformity of the closure to the ideal. Preferably, the inspection head is connected to a source of pressurized fluid for testing both the depth of penetration and the adequacy of the sealing ring. Closures capable of maintaining a seal at a predetermined level of pressure are automatically passed and closures failing to meet this test are automatically rejected. A preferred embodiment for accepting crown bottle caps from a plurality of lining machines is described in detail.

46 Claims, 20 Drawing Figures

BOTTLE CAP INSPECTING MACHINE

BACKGROUND OF THE INVENTION

This invention relates to a machine for automatically inspecting shaped, lined closures such as bottle caps and rejecting those which do not meet pre-established criteria for shape and seal. More particularly, it relates to a machine for automatically inspecting and rejecting closures having resilient sealing liners.

Proper inspection of bottle closures is a matter of considerable importance, both to the ultimate consumer and to bottlers. It is important to the consumer because defective closures can leak, permitting contamination of the contents and undesired escape thereof. It is important to the bottler for the same reasons and for the additional reason that defective closures can jam modern high speed bottling equipment.

While bottle caps are manufactured at high rates of speed using mass production techniques, they are typically inspected at rates of speed limited to the effective speed of human visualization and manual removal. Commercial lining machines, such as are described in U.S. Pat. Nos. 3,135,019 and 3,360,827, issued to Ernest O. Aichele, can provide plastic sealing linings to preformed bottle closure shells at rates of 1400 caps per minute. Consequently, most cap manufacturers inspect only a small percentage of the lined caps and statistically extrapolate these inspections to cover the entire production. This technique is time-consuming, subjective, and inherently unreliable.

Similarly, most bottlers also inspect only a small percentage of caps purchased. Typically, they inspect one box per shipment, and if the number of defects in that box exceeds their maximum, they reject the entire shipment.

SUMMARY OF THE INVENTION

In accordance with the present invention, methods and machinery are provided for automatically inspecting shaped, lined closures and rejecting those which fail to meet pre-established criteria for shape and seal. Specifically, shaped closures having concave interior portions and resilient sealing liners are supplied to an inspection station comprising one or more female inspection nests for receiving individual closures and one or more respective male inspection heads for insertion into the concave portions of respective closures. The inspection heads are provided with exterior shapes approximating the interiors of ideal closures so that penetration into the closure indicates the conformity of the closure to the ideal. Preferably the inspection head is connected to a source of pressurized fluid for testing both the depth of penetration and the adequacy of the sealing ring. Closures capable of maintaining a seal at a predetermined level of pressure are automatically passed for shipment and closures falling to meet this test are automatically rejected. A preferred embodiment for accepting crown bottle caps from a plurality of lining machines is described in detail.

BRIEF DESCRIPTION OF THE DRAWINGS

The advantages, nature, and various additional features of the present invention will appear more fully upon consideration of the illustrative embodiments now to be described in detail in connection with the accompanying drawings in which.

For convenience of reference, the same reference numerals are useful for the same elements throughout the drawings.

DETAILED DESCRIPTION

A. Overall System Operation (FIG. 1)

Figure 1:
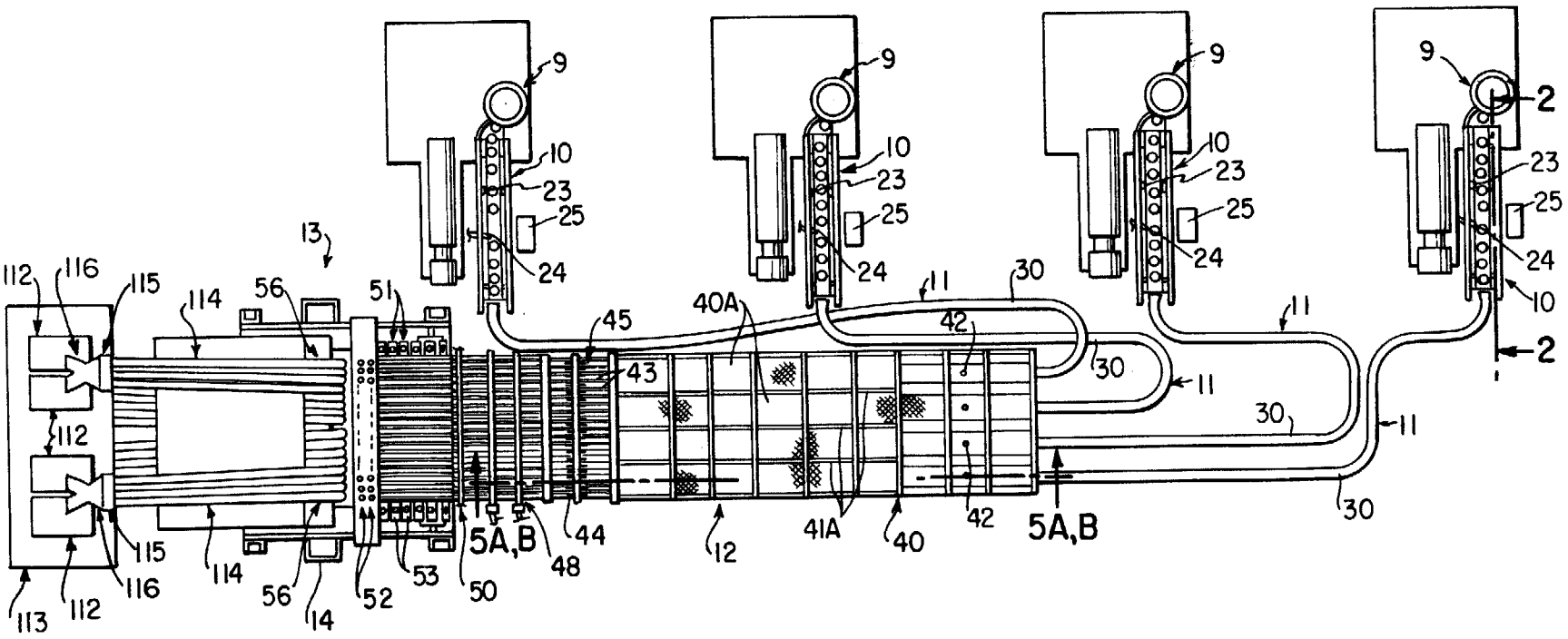
FIG. 1 is a schematic illustration of an automatic closure inspection system in accordance with a preferred embodiment of the invention.
Figure 2A:
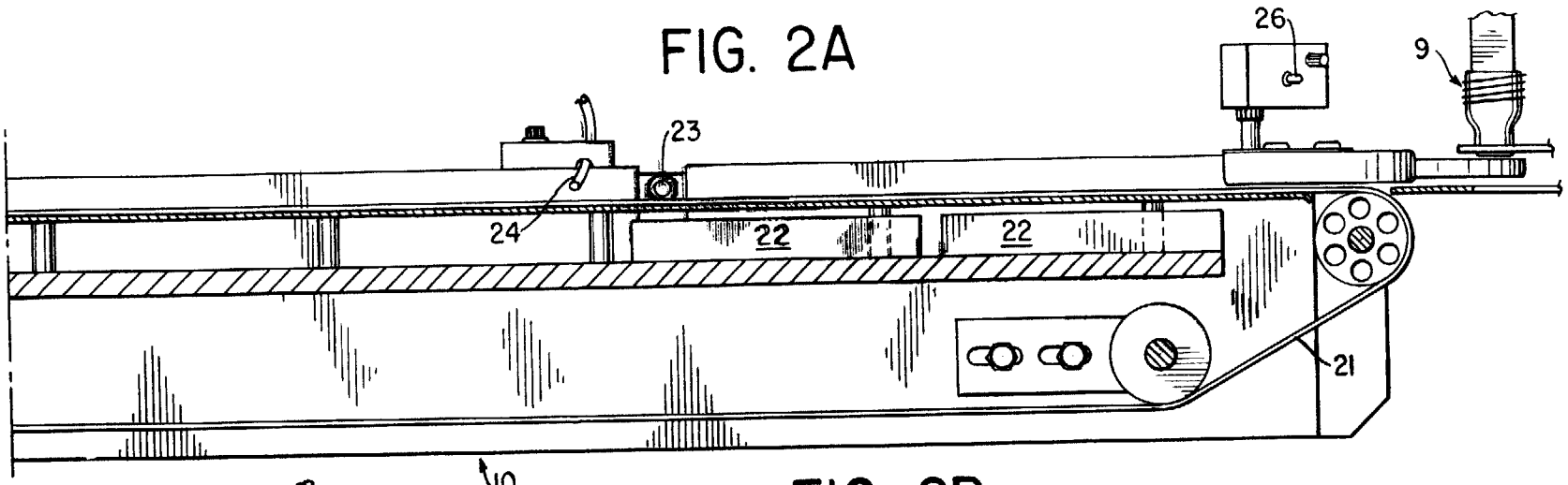
FIGS. 2A and 2B taken together constitute a section view along the line 2—2 of FIG. 1. They show a preferred take-off and transport mechanism useful in the system of FIG. 1.
Figure 2B:
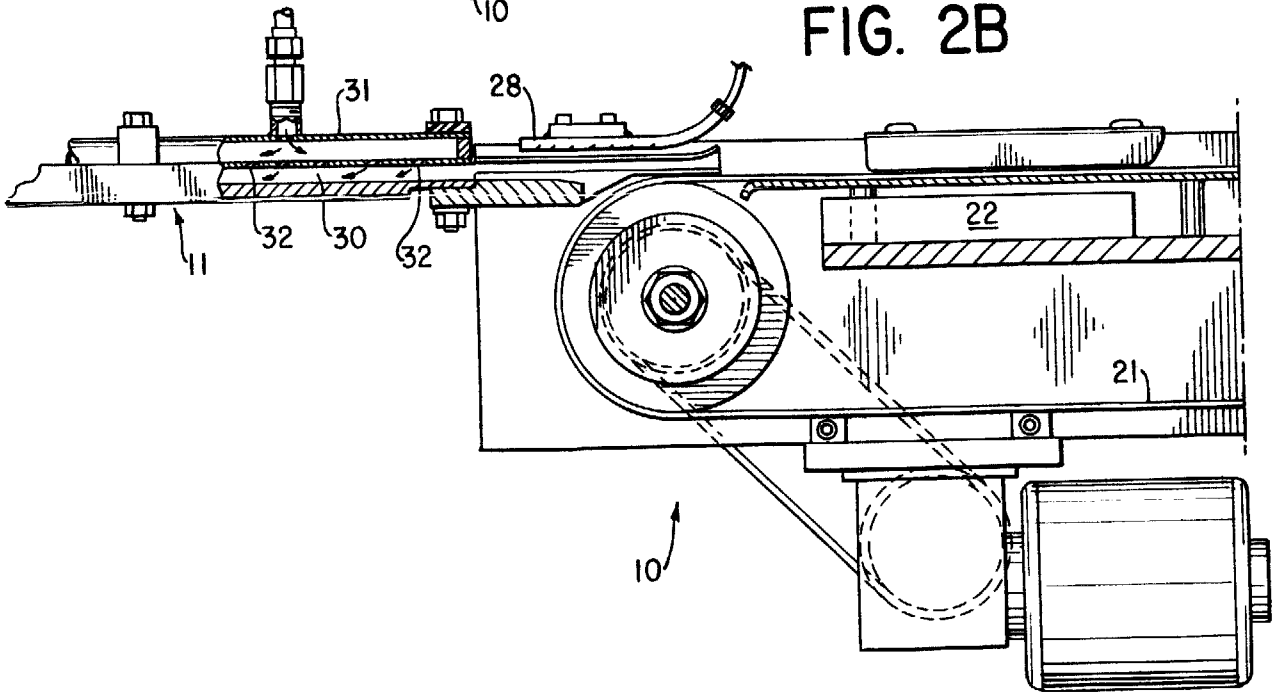
Figure 3A:
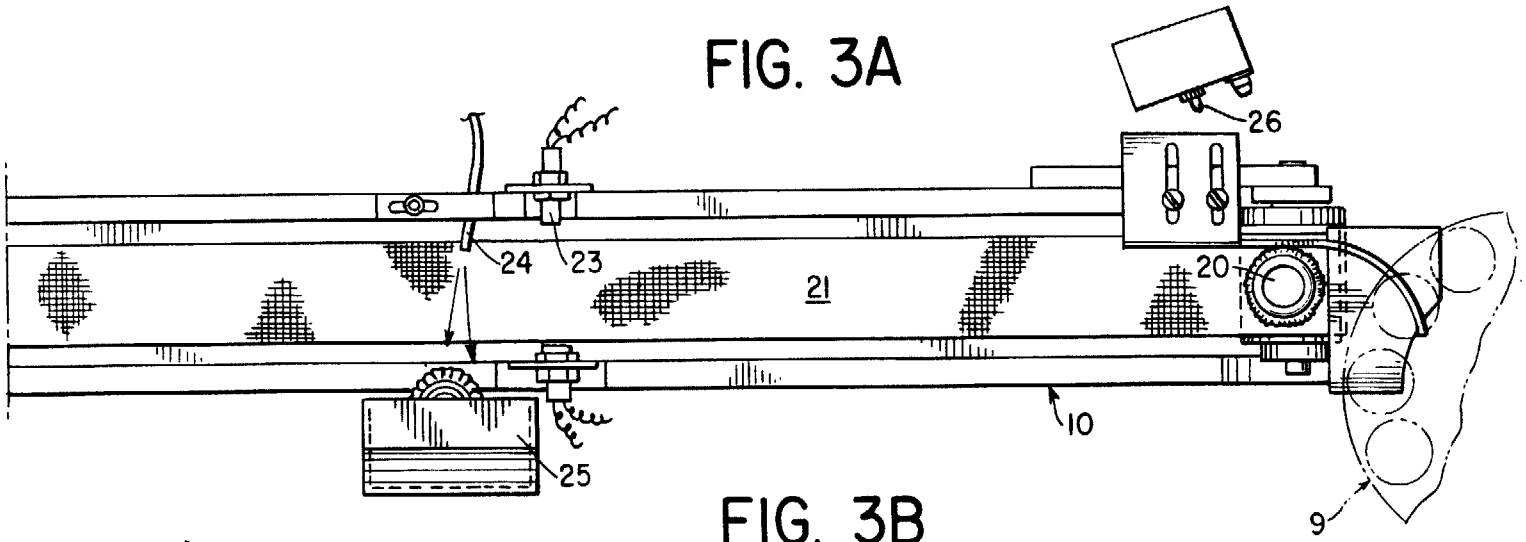
FIGS. 3A and 3B taken together constitute a plan view of the preferred take-off and transport mechanism useful in the system of FIG. 1.
Figure 3B:
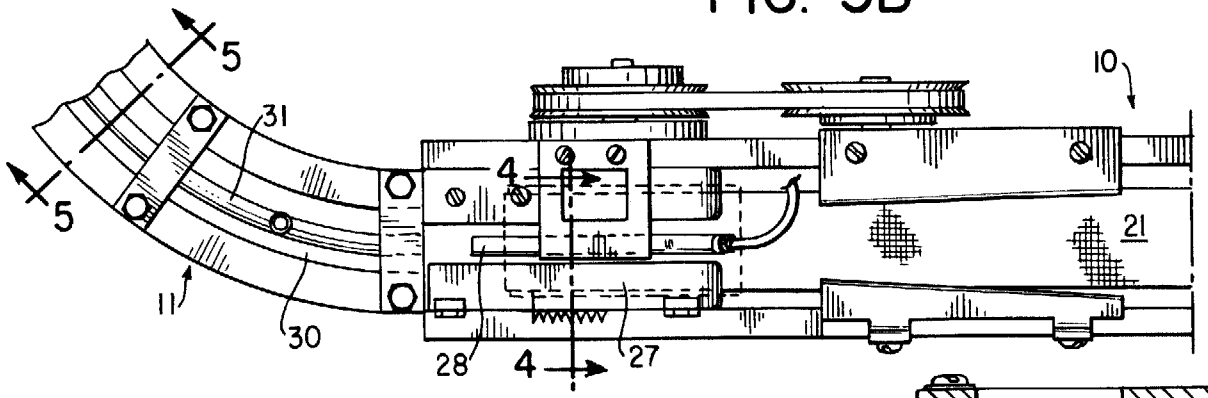
Figure 4:
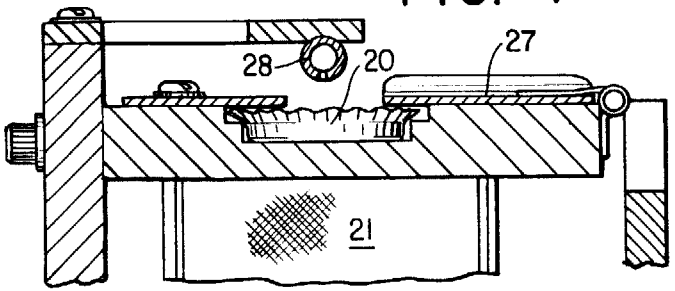
FIG. 4 is a section view along the line 4—4 of FIG. 3B, illustrating the cross section of the triggered gate of the take-off mechanism.

Referring to the drawings, FIG. 1 is a schematic illustration of a preferred automatic closure inspection system in accordance with the invention, which embodiment is specifically adapted for inspecting plastic lined crown bottle caps (crowns) as they are received from plural lining machines 9. In essence, the system comprises one or more take-off mechanisms 10 for receiving hot, lined crowns from respective lining machines 9, and respective transport mechanisms 11 for transporting crowns from the take-off mechanisms to a common cooling station 12 wherein the crowns are permitted to cool to a pre-determined temperature range and collimated into one or more rows for feeding into an inspection station 13.

At inspection station 13, the crowns are fed into female inspection nests and inspected by male inspection heads inserted into the concave portions of the caps. The ability of the sealing ring to provide a seal with the head against pressurized fluid tests both the seal and the extent of penetration of the shaped head into the crown, thus providing a measure of the conformity of the crown to an ideal shape. Unacceptable crowns are rejected into a reject container 14 and acceptable crowns are passed into packaging station 15 wherein they are counted and deposited into suitable containers. The preferred mechanisms and stations will now be described in detail in connection with FIGS. 2 through 11.

B. The Take-Off And Transport Mechanisms (FIGS. 2 Through 5)

The primary purposes of the take-off and transport mechanisms are to receive crowns from a lining machine at its commercial production rate and to transport them away from the immediate vicinity of the lining machine. In addition, the preferred embodiment advantageously provides means for detecting and rejecting grossly defective crowns likely to jam subsequent mechanisms in the inspection system and means for detecting jams in the take-off mechanism and automatically shutting off the liner machine in the event of such jams. In addition, the take-off mechanism advantageously aligns the crowns for proper presentation to the subsequent transport mechanism.

FIGS. 2A, 2B, 3A, and 3B illustrate a preferred take-off mechanism 10 for receiving hot, lined crowns 20 from liner machine 9 comprising a belt conveyor 21 of non-magnetic material such as neoprene centered over one or more strips 22 of magnetized material. The crowns are centrifugally ejected from the liner machines with their concave interior portions facing up. The fields of the magnetized strips help draw crowns from the liner machine onto the conveyor, retain the orientation of the concave interiors, hold the crowns into contact with the moving conveyor, and center the crowns over the strips.

As a preliminary inspection mechanism, a photoelectric cell 23 is provided for detecting grossly defective crowns or clusters of crowns having a height exceeding a predetermined value. The cell is coupled to pneumatic blow off tube 24 through a suitable delay line for automatically blowing off the conveyor into a reject container 25 crowns determined to have an excessive height. In addition, an optional manual switch 26 is provided for switching blow off tube 24 into a sweep mode for sweeping off all crowns. This mode is useful, for example, during liner machine start-up wherein a high percentage of defective crowns are sometimes encountered.

A jam detector in the form of a triggered gate 27 is provided at the end of conveyor 21 at the entrance to transport mechanism 11. Any substantial accumulation of crowns under this gate produces an upward pressure which triggers the gate open providing an exit for the crowns and activating a microswitch to shut down liner machine 9.

Means, such as air nozzle 28, are provided for forcing the crowns from conveyor 21 into transport mechanism 11.

While the take-off mechanisms removes the crowns from the immediate vicinity of the liner machines so that accumulated crowns will not interfere with liner machine operation, transport mechanisms 11 receive the crowns from the take-off mechanisms and remove them to a more remote location wherein the remaining cooling, inspection, and packaging steps can be performed without interfering with liner machine operation. A principle advantage of using appropriate transport mechanisms is that the outputs of several liner machines can be transported to a single remote cooling station and be further processed in single respective inspection and packaging stations.

Figure 5:
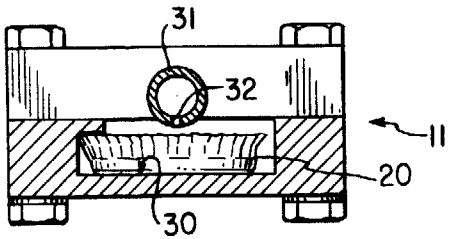
FIG. 5 is a section view along the line 5—5 of FIG. 3B, illustrating the cross section of the air track of the transport mechanism.
Figure 6A:
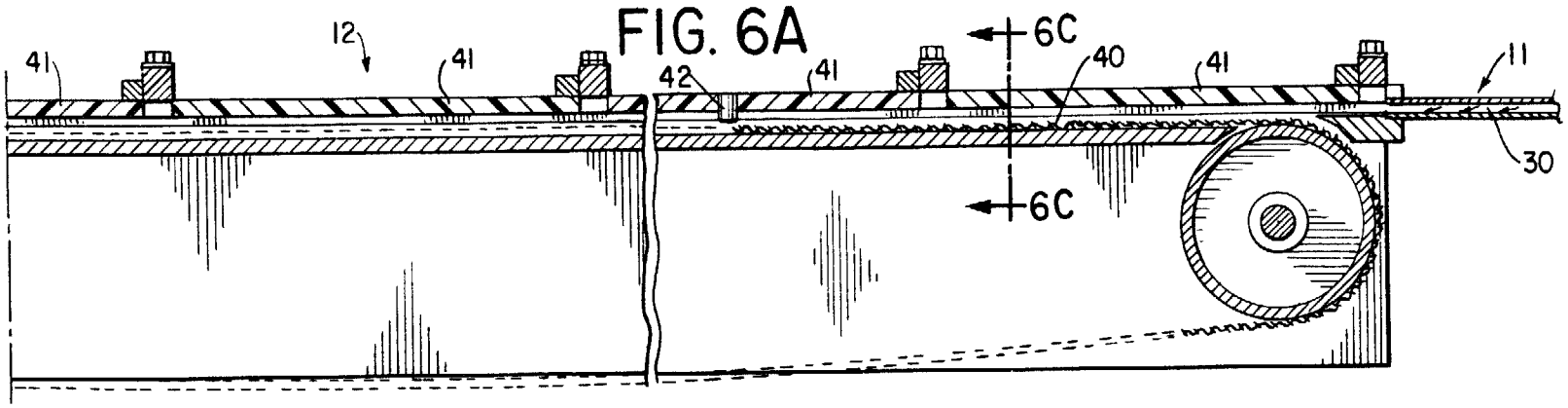
FIGS. 6(A) through 6(E) illustrate a preferred cooling station useful in the system of FIG. 1.
Figure 6B:
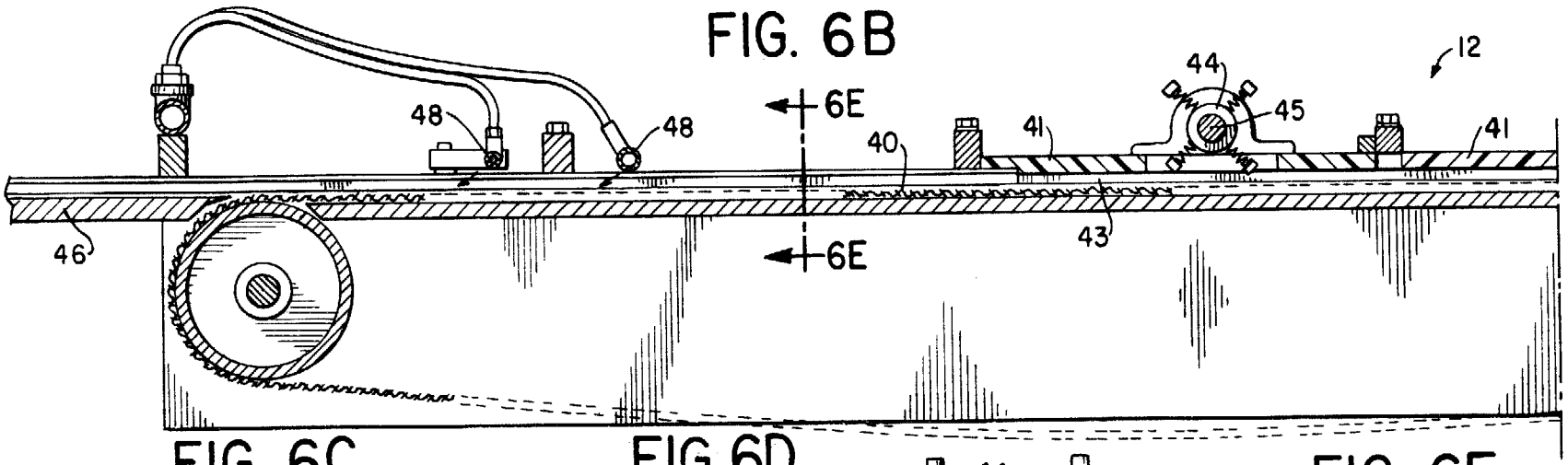
Figure 6D:
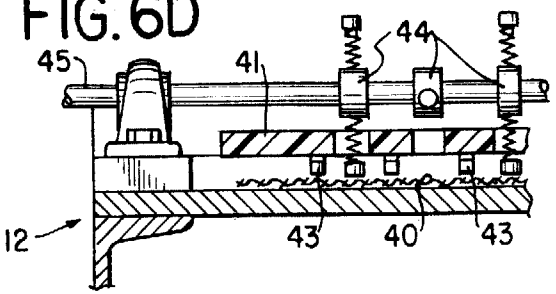
Figure 6E:
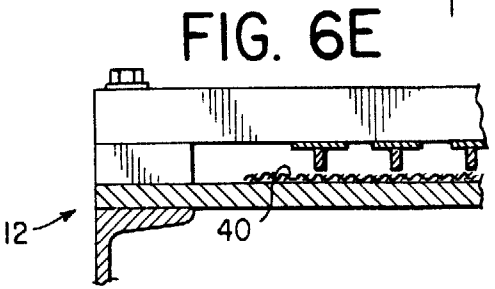
Figure 6C:
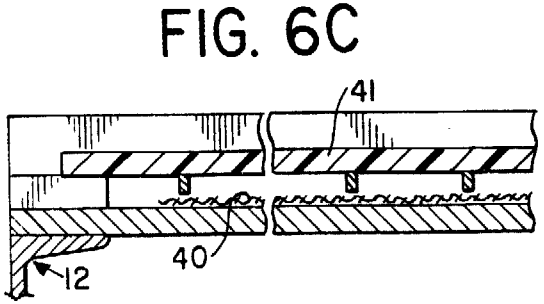

FIGS. 1 and 5 illustrate a preferred transport mechanism 11 in the form of an air track 30 and a tubular pneumatic manifold 31. The air track preferably defines, on three sides, a track for a single crown. Tubular manifold 31, which can be centrally disposed above the track on the fourth side, includes a plurality of axially slanted air passageways 32 for directing a plurality of streams of air in the direction of the track. These air streams drive the crowns along the track, around optional gradual curves therein, to the end of the track and the cooling station 12 beyond. Preferably air tracks 30 all have substantially the same length so that caps from each lining machine reach the cooling conveyor at substantially the same temperature.

C. The Cooling Station (FIGS. 6A Through 6E)

The primary function of the cooling station is is to gradually cool the hot caps to a temperature within a predetermined range preliminary to the inspection step. Such cooling is desirable in order to permit the plastic sealing liner, typically a thermoplastic material, to solidify to a point where it can be tested without being permanently deformed and can demonstrate an effective seal without sticking to the test equipment. In the preferred arrangement, the cooling station can perform the additional functions of distributing the received crowns among several rows for presentation to the inspection station 13.

FIGS. 6(A)–6(E) illustrate a preferred cooling station 12 comprising a cooling conveyor 40 which can be made of neoprene-coated wire mesh belting. This conveyor, which moves relatively slowly as compared to the conveyor of take-off mechanism 10, carries the crowns exposed to ambient air slowly towards the inspection station, permitting them to cool. Optional covers 41 of transparent plastic, for example, can be placed over the cooling conveyor to prevent too rapid cooling. In this preferred embodiment, the cooling conveyor moves at a speed of 50 feet per minute and carries the crowns a distance of 8 feet to permit them to cool to a temperature of about 120° F.

Advantageously, the caps arriving from each respective lining machine are kept separate throughout the inspection process so that an improperly functioning machine can be quickly identified. This isolation can be readily provided at the cooling station by transversely spaced apart vertical isolation walls (41A of FIG. 1) for keeping separate the caps arriving from different air track 30 and dividing the conveyor into a plurality of transversely spaced subchannels (40A of FIG. 1) corresponding to the outputs of respective lining machines 9.

To distribute the crowns on the conveyor and subsequently among a plurality of rows, resilient bumpers 42, which can be neoprene, are disposed in the path of crowns from respective air tracks 30 a few feet from the air track exit onto the cooling conveyor. Conveniently the bumper 42 can be suspended from plastic cover 41. Crowns shooting from the air track onto the conveyor collide with the bumper bar and rebound onto randomly distributed transverse positions on the conveyor 40 within their respective subchannels 40A.

A plurality of collimating walls 43 are provided, preferably extending downward from cover 41 to constrain the randomly distributed crowns into a plurality of transversely spaced, longitudinally extending rows for presentation to the inspection station. In order to prevent jamming at the leading edges of walls 43, agitators in the form of rotating resilient flails 44 are positioned midway between adjacent walls 43 slightly ahead of the leading edges. These flails can conveniently be attached to a common rotating shaft 45 disposed above the cover with the flails beating down through slots in the cover. The direction of rotation should, of course, drive the crowns between the collimating walls.

The cooling conveyor is terminated by a dead plate 46 and flexible gate (47 of FIG. 7) for transversely aligning the leading crowns in each of the rows for presentation to the inspection station. One or more transverse tubular manifolds 48 provide air streams to drive the crowns from the cooling conveyor along the rows defined by adjacent collimating walls across dead plate 46 to flexible gate 47, where they are presented as transversely aligned columns to the sector wheels 50 of the inspection station 13. While the preferred embodiment utilizes a common cooling conveyor for a plurality of machines, it is clear that a plurality of separate cooling conveyors could be used in the alternative.

D. The Inspection Station (FIG. 7)

The primary function of the inspection station is to ensure that only acceptable crowns pass.

Figure 7:
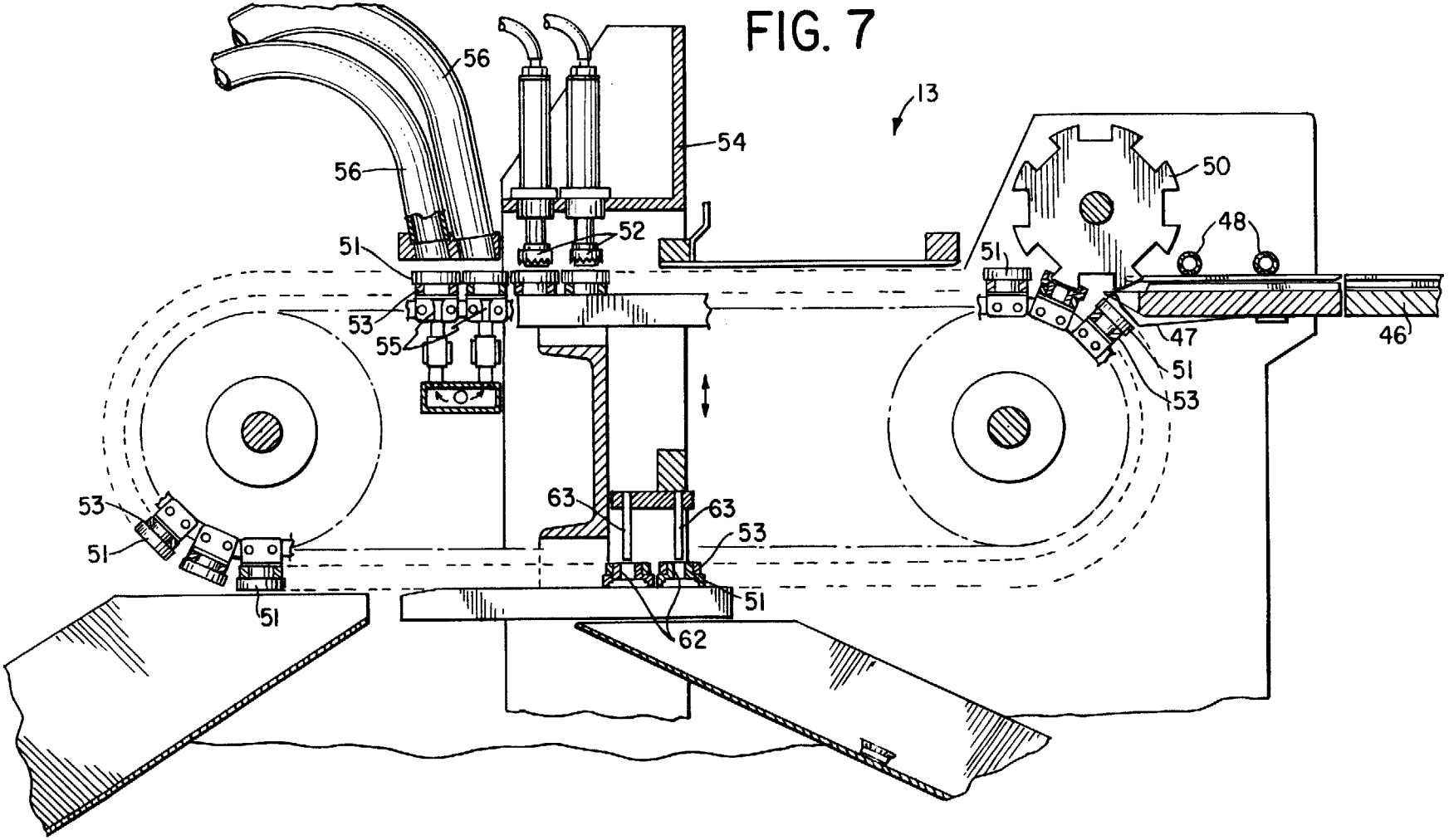
FIG. 7 is a partially schematic illustration of a preferred inspection station useful in the system of FIG. 1.

FIG. 7 illustrates a preferred inspection station 13 comprising one or more transfer devices such as sector wheels 50 for transferring crowns from the exit gate 47 of the cooling station into one or more female inspection nests 51 for receiving the crowns and retaining them during inspection, and one or more inspection heads 52 for insertion into the concave interior portions of the crowns.

As shown in the preferred arrangement, a plurality of sector wheels 50 are arranged in a transverse column corresponding in transverse spacing to the transverse spacing between successive rows of crowns. Similarly, a plurality of inspection nests 51 are arranged in a movable, spaced array as defined by a chain of nest bars 53, each having a plurality of corresponding transversely spaced nests. As can be readily appreciated, crowns from each transverse subchannel 40A of the conveyor 40 are supplied to respective corresponding transverse portions of the nest array.

The inspection heads 52 are preferably arranged in one or more transversely spaced columns. Conveniently, they are mounted on beam 54 for reciprocating the heads into and out of caps contained in the nests.

Figure 8:
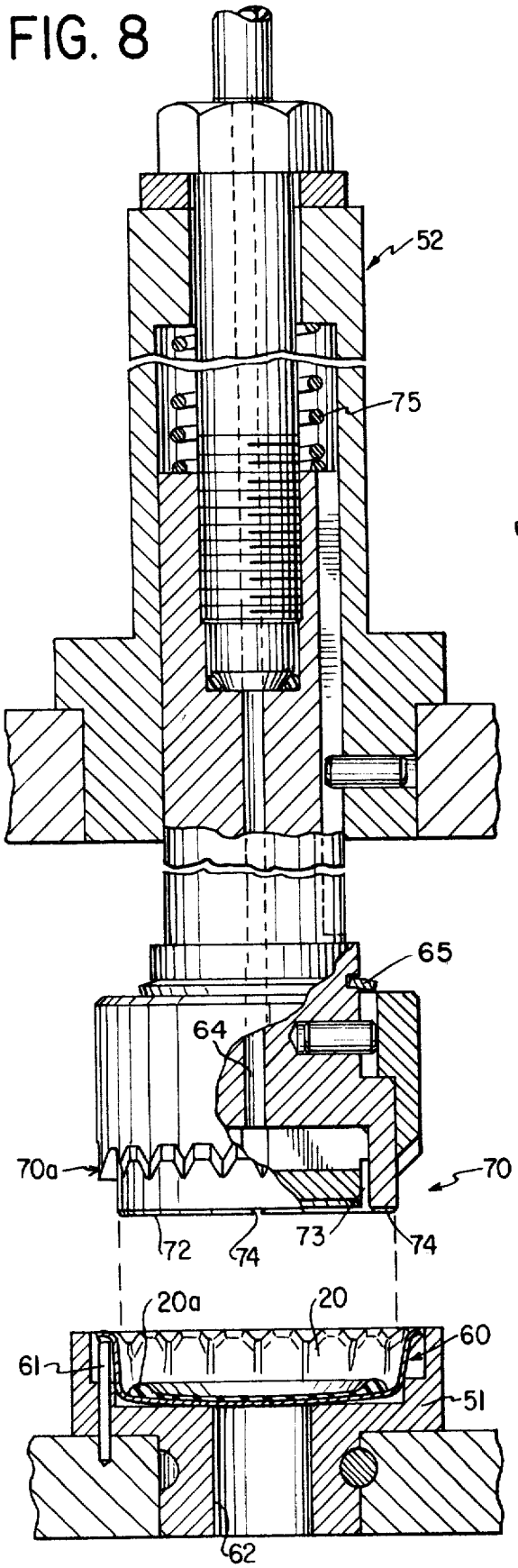
FIG. 8 is a cross section of a preferred inspection head useful in the inspection station of FIG. 7.

The structure of a preferred inspection nest 51 for corrugated crowns is shown in FIGS. 7 and 8. The principal features of the nest are a receiving cavity 60 of sufficient diameter to receive a corrugated crown, orientation means such as pin 61 for constraining the circumferential position of the crown, and an ejection aperture 62 for permitting entry of pneumatic or mechanical ejection or means, such as rejection fingers 63.

The structure of a preferred inspection head 52 for corrugated crowns is shown in FIG. 8. In substance, the inspection head comprises a shaped insertion portion generally denoted 70 having an exterior shape generally approximating the interior shape of an ideal crown so that its penetration into the crown provides a measure of conformity to that ideal shape. The inspection head is connected by passageway 64 to a source of pressurized fluid (not shown), and O-ring seals 65 are used where necessary to maintain coupling seals.

In the embodiment illustrated, the principal shape-testing portion of the inspection head is a ring of saw-tooth-shaped projections **70*a* corresponding in size and circumferential distribution to the desired crown corrugations. Depth of penetration and adequacy of the sealing ring are both tested by a seal testing portion 72 which includes an aperture 73 for pressurized fluid. Preferably, this aperture is in the form of an annular ring having a diameter approximately the same as the nominal diameter of the plastic sealing ring 20*a*. Channels 74 are preferably provided in the bottom portion of 70 in order to permit fluid to escape in the absence of a sealing ring. A resilient loading means, such as spring 75, is provided so that the insertion portion and the seal testing portion make resilient contact with the crown, preferably with aperture 73 in contact with sealing ring 20*a***. Contact pressure is about 20 pounds per square inch.

In the preferred embodiment, the chain of nest bars 53 is step-driven beneath the inspection heads and stopped during the inspection operation while the inspection heads are inserted into the underlying crowns and withdrawn. After withdrawal of the inspection heads, the chain is advanced an appropriate number of nest columns to place new crowns under the inspection heads. As the chain is advanced, sector wheels 50 rotate to pick up additional crowns and drop them into nests 51 for a later inspection operation, and as the previously inspected crowns advance from under the inspection head to the next resting position, acceptable crowns are ejected into tubes 56. Conventional mechanical coupling and camming techniques well-known in the art are utilized to cam the nest chain for intermittent drive and to coordinate the movement of the nest chain, the rotation of the sector wheels, and the reciprocation of the inspection heads so that crowns picked up by the sector wheels drop into the nests and so that the inspection heads enter into and withdraw from crowns retained by the nests. The rejection fingers 63 can be conveniently synchronized to reciprocate with the inspection heads.

In a preferred embodiment for inspecting the output of 4 lining machines, successive nests are longitudinally spaced 1.5 inches apart and transversely spaced 1.5 inches apart. Two columns of 24 inspection heads each, simultaneously test 48 crowns in an inspection cycle of approximately 0.5 second.

The operation of the inspection heads can be understood by reference to FIGS. 9A, 9B, 9C, and 9D which illustrate the penetration of an inspection head in an acceptable crown and various typical unacceptable crowns, respectively.

Figure 9A:
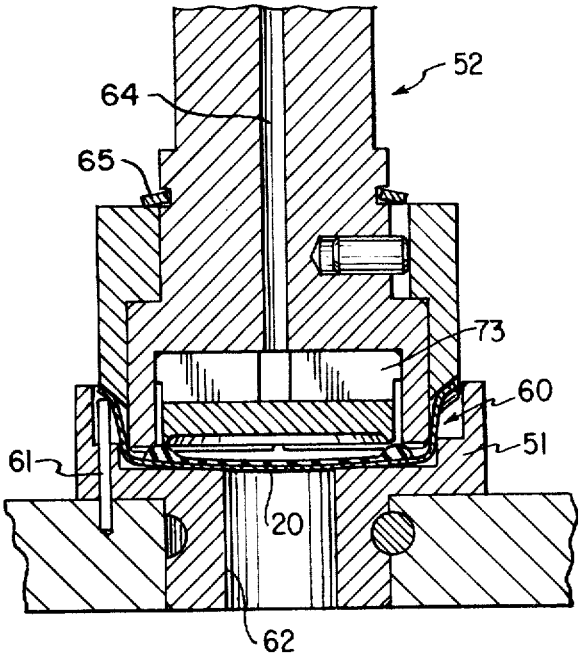
FIGS. 9(A)-(D) illustrate the inspection step for acceptable crowns and various types of unacceptable crowns.

FIG. 9(A) illustrates inspection of an acceptable crown. The inspection head has penetrated to a predetermined acceptable depth and the sealing ring maintains a seal for a predetermined pressure, typically 15 lbs. per square inch.

Figure 9B:
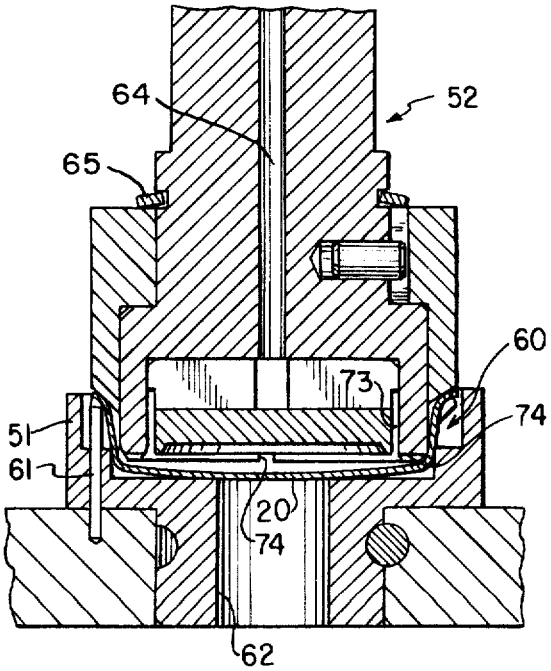

FIG. 9(B) illustrates inspection of a crown which is unacceptable because of the absence of a sealing ring. Here the depth of penetration is adequate, but the seal is not maintained and air escapes through the channel in 70.

Figure 9C:
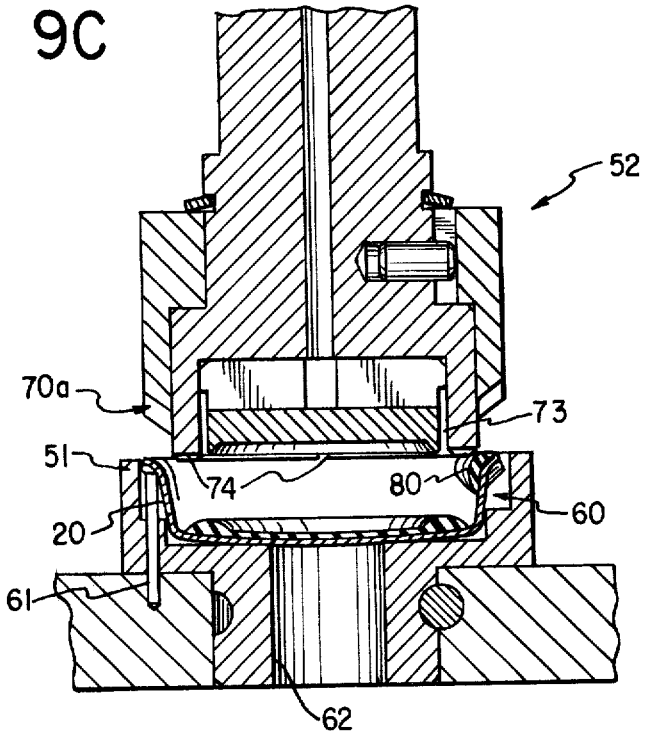

FIG. 9(C) illustrates inspection of a crown which is unacceptable because of the application of a double amount of plastic in the liner-forming process, forming a Module 80 on the crown portion. Here both the depth of penetration and the sealing are inadequate.

Figure 9D:
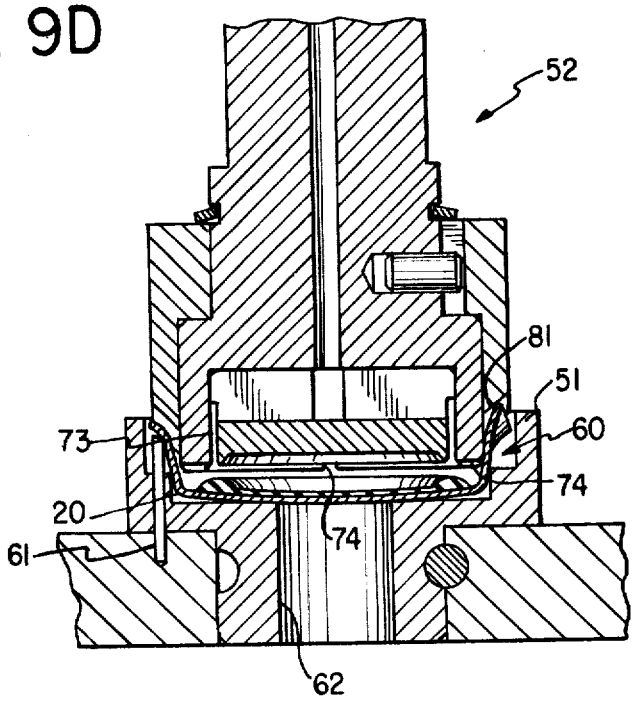

FIG. 9(D) illustrates inspection of a crown which is unacceptable because of a bent crown portion 81. Again both depth of penetration and seal are inadequate. Thus, it can be seen that the adequacy of seal here provides information regarding the adequacy of the shape and the sealing liner upon which a simple threshold decision to accept or reject can be based.

Referring back to FIG. 7, if the effectiveness of seal is in conformance with empirically predetermined acceptance criteria, eject air nozzles 55 are activated through appropriate memory or delay means to subsequently eject the acceptable crown into eject chutes 56 for delivery to the packaging station 15. If, however, a non-acceptable crown is indicated, it is not there ejected but permitted to continue around the belt where it will drop into reject boxes. Optionally, a stripper bar with rigid rejection fingers 63 timed in relation to the movement of the nest chain, can be provided for pushing through apertures 62 and insuring rejection of unacceptable crowns. Preferably a plurality of reject containers are provided for separately receiving the reject crowns arriving from different respective subchannels 40A. In this manner, the rejects from each of the respective lining machines are delivered to their own separate reject containers.

In substance, the ejection circuitry associated with the inspection process comprises a sensing device for sensing whether or not pressure of a predetermined level can be developed between the inspection head and the enclosure being tested, a memory device responsive to the sensing means for storing such information until the closure has been moved from under the inspection head and ejection means, responsive to the memory device for selectively ejecting acceptable crowns.

Figure 10:
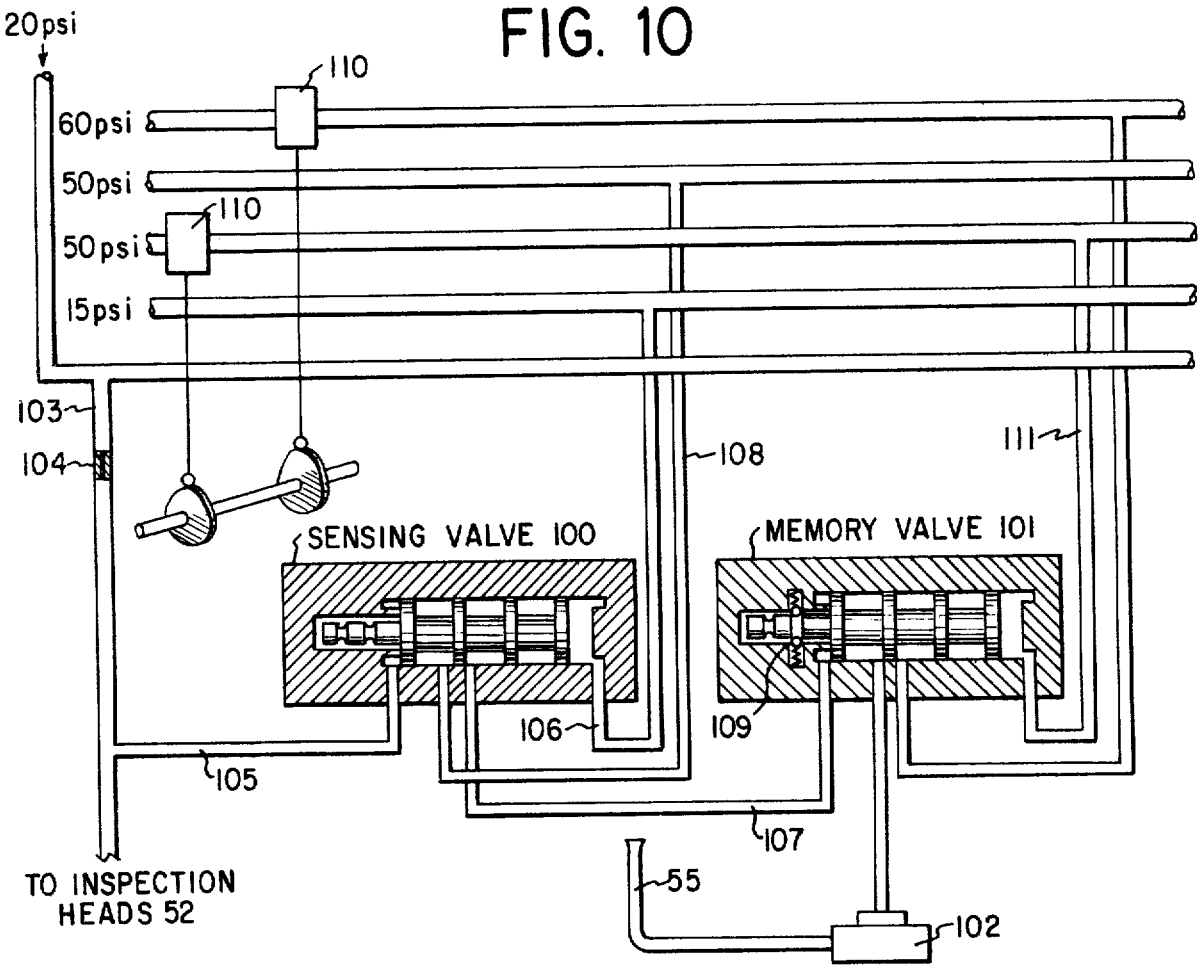
FIG. 10 illustrates preferred pneumatic circuitry useful in the inspection station of FIG. 7.

FIG. 10 illustrates preferred pneumatic ejection circuitry comprising a sensing valve 100 responsive to the presence or absence of an effective seal between the inspection head and the closure, a memory valve 101 responsive to the state of the sensing valve; and an ejection booster valve 102, responsive to the state of the memory valve, for ejecting acceptable closures after they move from under the inspection heads.

In operation, the inspection head is inserted into a closure, desirably forming a seal with the seal ring. Pressurized fluid is introduced between the head and the seal ring and increased to a predetermined test pressure level. In the preferred arrangement, the inspection head communicates with a source of 20 psi air through a conduit 103 and a control orifice 104 which reduces its initial pressure to 11.5 psi while permitting a gradual pressure build-up towards 20 psi.

The input of sensing valve 100 is placed in pneumatic communication with the inspection head-closure seal by conduit 105 and the valve is biased in the closed state through conduit 106 to a source of the predetermined test pressure for a satisfactory seal, here 15 psi. If the head-closure seal is effective, the input pressure will increase from 11.5 psi to a pressure greater than 15 psi and thus drive the spool of valve 100 to the right to its open state. In the absence of an effective seal, valve 100 remains in the closed state.

The opening of sensing valve 100 results in the opening of memory valve 101. This result is effected through sensing valve output conduit 107 connected to the input of memory valve 101. When sensing valve 100 is in the open state, the input of memory valve 101 is placed in communication with a source of pressurized fluid, e.g., air at 50 psi through conduits 107 and 108. This fluid drives the spool of the memory valve to the right to the open state. The memory valve is temporarily retained in its open position by detent 109.

The opening of memory valve 101 results in ejection of acceptable closures. When the memory valve is open, eject booster valve 102 is placed in communication with a source of pulsed pressurized fluid, e.g., 60 psi air, pulsed to coincide with movement of the inspected closure from a position under the inspection head to a position under the eject chutes. A reset pulse, e.g., 50 psi pulsed air, is then applied to the memory valve through conduit 111 to drive the memory valve back to its closed state. The pulsed sources are preferably timed through cam switches 110 cam coupled to the drive shaft for the inspection nest chain.

The sensing valve is automatically reset by the 15 psi bias from conduit 106 upon withdrawal of the inspection head from the closure.

The advantage of the strategy of ejection embodied in this circuitry is that it ensures against the shipment of defective crowns. Ejection sometimes fails to dislodge a closure. In such event, it is better that a good closure should be rejected than a bad closure shipped.

E. The Packaging Station (FIGS. 1 and 11)

The function of the packaging station is to deposit predetermined numbers of acceptable crowns in suitable packages, such as cartons. In the embodiment illustrated in FIG. 1, the acceptable crowns are delivered by the ejection chutes 56 through counter arrays 115 to carton loading means such as controllable gates 116. The crowns pass through the controllable gates into one or more cartons 112 resting on a controllable shaker platform 113. Upon the counting of a predetermined number of crowns, e.g., 10 gross, the shaker counter can be automatically activated to shake caps and reduce their bulk, and upon counting of a predetermined total for a carton, the controllable gate can be automatically shifted to deposit additional crowns in a different carton.

The preferred embodiment utilizes a plurality of lining machines and a corresponding plurality of carton loading means so that the output of each lining machine is loaded at separate, identifiable locations. Specifically, the ejection chutes are divided into a plurality of bundles 114 (two of the four shown in FIG. 1), each bundle comprising those chutes having transverse positions for receiving crowns arriving at the inspection station from a single respective subchannel 40A. Each such bundle delivers acceptable crowns to a different carton loading gate, and thus each gate loads crowns from a different identifiable lining machine.

Figure 11:
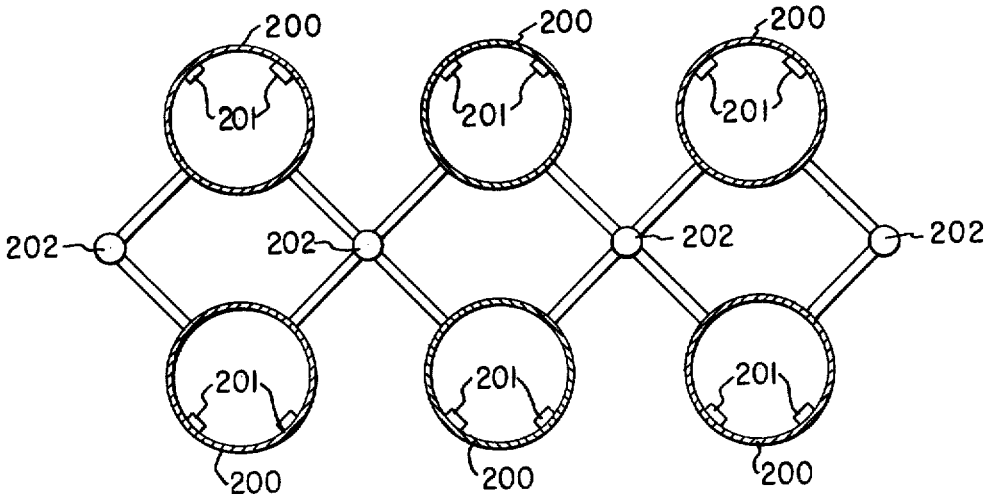
FIG. 11 illustrates a preferred counter arrangement useful in the system of FIG. 1.

A preferred counter array 115 for controlling conventional gates and shaker platforms is illustrated in FIG. 11. As can be seen, the counter arrangement utilizes a double eye system for each tube 200 wherein two photodetectors 201 are provided for detecting substantially perpendicular intersecting light paths, and light sources 202 provide beams for a plurality of adjacent tubes. The two photodetectors can conveniently be connected in series so that the passage of a single crown produces only one output pulse, and the outputs of each serial pair are fed to respective inputs of a parallel-input-to-serial-output device whose output, in turn, is connected to a conventional counter (not shown).

F. Alternative Embodiments

While the invention has been described and illustrated as a machine for inspecting closures at the point of manufacture prior to shipping, with but few modifications it can equally well be used by bottlers or intermediate purchasers to inspect closures at any time prior to their application on containers. Specifically, for subsequent inspections, one or more conventional hopper dispensers are substituted for the lining machines 9 of FIG. 1. Preferably, in such arrangements, the output of hopper is fed directly to the air transport mechanism, thus eliminating the take-off mechanism 10 of FIG. 1.

Advantageously, plastic lined crowns are inspected at a slightly elevated temperature in order to enhance the resilience of the plastic and thereby improve the reliability of the inspection process. Since the crowns to be inspected by a bottler or intermediate purchaser are likely to be at ambient temperature. If desired, conveyor apparatus similar to cooling conveyor 40 can be used in conjunction with overlying heating lamps to heat closures to a desired temperature, e.g., 120° F. Thus, in the practice of the invention, cooling station 12 can be more broadly characterized as a temperature control station for heating or cooling the closures, as necessary, to ensure that they fall within a predetermined temperature range for testing. This is advantageously accomplished by carrying the closures on a conveyor through a heating or cooling environment.

Moreover, a bottler may wish to feed accepted closures directly into the automatic bottling machinery rather than to repackage them. In such an instance, a conventional hopper dispenser can be positioned, in lieu of a carton, for receiving accepted closures.

While the invention has been described in connection with a small number of embodiments, it will be apparent to those skilled in the art that various changes and modifications can be made without departing from the spirit and scope of the invention.

We claim:

1. In an inspection apparatus for automatically inspecting closures of the type having a concave interior portion, said apparatus including an inspection station, output station and rejection station, feeding means for serially supplying closures to said inspection station for inspection thereof, inspection means including at least one inspection head located at said inspection station for insertion into the concave interior of the closures and sensing means connected to said at least one inspection head for sensing the presence or absence of certain physical characteristics of the interior of the closure as included in an acceptable closure and delivery means responsive to sensing an acceptable closure with said characteristics for ejecting said acceptable closures from the feeding means at said output station and ejecting unacceptable closures not having said characteristics from said feeding means at said rejection station, the improvement characterized in that:

(a) the inspection means includes pressure means for supplying pressurized fluid to each of said inspection heads at a predetermined positive pressure;

(b) each inspection head has a shape correlated to the interior of acceptable closures having said characteristics to form a fluid tight seal therewith which is capable of withstanding said predetermined positive pressure; and (c) said sensing means is connected between said inspection heads and said delivery means for sensing the pressure developed in the inspection heads and actuating the delivery means to eject acceptable closures from the feeding means when said closures are at said output station.

2. Apparatus according to claim 1 wherein said means for supplying closures to said inspection station comprises a sectored transfer wheel.

3. Apparatus according to claim 1 wherein:

said means for supplying closures comprises a plurality of inspection nests arranged in an array of transversely spaced apart rows and longitudinally spaced apart columns;

said means for supplying closures further comprises collimating means for arranging said closures in a plurality of transversely spaced apart rows, aligning means for transversely aligning the leading closures of each said row into an aligned column; and transfer means for transferring the closures of said aligned column into a corresponding column of inspection nests.

4. Apparatus according to claim 3 wherein said collimating means comprises a plurality of transversely spaced apart collimating walls.

5. Apparatus according to claim 3 wherein said aligning means comprises a transversely extending flexible gate.

6. Apparatus according to claim 3 wherein said transfer means comprises a plurality of sectored wheels mounted on a common rotatable axis at spaced positions corresponding to said transversely spaced apart rows.

7. Apparatus according to claim 3 wherein said at least one inspection head comprises a plurality of inspection heads arranged in at least one column at spaced apart positions corresponding to said transversely spaced apart rows.

8. Apparatus according to claim 1 wherein said inspection station comprises at least one inspection nest having lateral support means for substantially surrounding an individual closure with the concave interior portion of said closure opening outwardly away from said nest.

9. Apparatus according to claim 1 wherein said at least one inspection head comprises a shaped insertion portion for fitting into the concave portion of a closure and an aperture for pressurized fluid.

10. Apparatus according to claim 9 wherein said at least one inspection head includes resilient loading means for biasing said insertion portion into resilient contact with said closure.

11. Apparatus according to claim 1 wherein said feeding means comprises a hopper dispenser.

12. In an inspection apparatus according to claim 1, the improvement characterized in that:

(a) the means for supplying closures to said inspection station includes at least one inspection nest for serially receiving respective, individual closures and retaining them during inspection with the concave interior thereof facing outwardly of the nest; and (b) the delivery means includes ejection means for ejecting closures from the nests after inspection thereof, the ejection means comprising:

(1) an ejection aperture extending into the interior of each nest at a location communicating with the closure retained therein for permitting the application of an ejection force against the closure in a direction urging the closure out of said nest; and (2) eject means located at said output station in alignment with each of the ejection apertures of said nests for supplying an ejection force to the acceptable closures to eject them from said feeding means.

13. In an inspection apparatus according to claim 12, the improvement characterized in that:

(a) the eject means at the output station is pneumatic.

14. In an inspection apparatus according to claim 13, the improvement characterized in that:

(a) the delivery means further includes secondary ejection means located at said rejection station in alignment with each of the ejection apertures of said nests for supplying an ejection force to each of the nests containing an unacceptable closure to eject such closure from the feeding means.

15. In an inspection apparatus according to claim 14, the improvement characterized in that:

(a) each inspection head comprises a testing portion having:

(1) an exterior periphery generally corresponding to the interior peripheral shape of an acceptable closure, (2) a passageway extending through the testing portion in communication with said pressure means and having an exit located inwardly of the peripheral exterior thereof for permitting passage of pressurized fluid to the central interior of the closure being inspected; and (3) a sealing surface disposed at the bottom of the testing portion radially outwardly of the exit of such passageway for sealing against the interior of said closure.

16. In an inspection apparatus according to claim 15 wherein the closures to be inspected each have a resilient plastic liner in the interior thereof with a raised sealing ring disposed adjacent the periphery thereof, the improvement characterized in that:

(a) the exit of the passageway through the testing portion of each inspection head is annular in shape and aligned directly with the sealing ring of the liner when the inspection head is inserted into the closure.

17. In an inspection apparatus according to claim 16 for inspecting closures having a corrugated skirt portion, the improvement characterized in that:

(a) the exterior periphery of the testing portion of each inspection head includes a ring of sawtooth-shaped projections corresponding in size, shape and circumferential distribution to the corrugated skirt of acceptable closures for mating therewith during inspection of said closures.

18. In an inspection apparatus according to any one of claims 12-17 for inspecting closures from the output of a plurality of closure lining machines, the improvement characterized in that:

(a) the means for supplying closures to the inspection station includes a plurality of inspection nests arranged in an array of rows extending along the direction of movement toward said inspection station;

(b) the inspection means includes a plurality of inspection heads arranged across the direction of movement of the closures toward the inspection station, one head being aligned with each of the rows of closures; and (c) the feeding means includes guiding means for collecting the output of each lining machine into separate rows and maintaining the segregation of the outputs while feeding thereof through the inspection, output, and rejection stations.

19. In an inspection apparatus according to claim 18, the improvement characterized in that:

(a) the inspection station, output station and rejection station are disposed at spaced locations along the path of movement of the closures; and (b) the delivery means includes control means connected between the sensing means and the ejection means to operate the ejection means in timed sequence to eject the closures at the output station which are sensed as acceptable closures when positioned in said inspection station and to eject the remaining closures when in said rejection station.

20. Apparatus for automatically inspecting closures of the type having concave interior portions comprising:

one or more inspection nests for receiving respective individual such closures and retaining them during inspection;

means for supplying such closures to said inspection nests;

one or more inspection heads shaped for insertion into the concave interior portions of such closures;

means for inserting said inspection heads into the concave interior portions of such closures retained in said inspection nests in order to make contact between said inspection heads and such closures;

means for supplying pressurized fluid between said inspection heads and such closures during said contact;

means responsive to the pressure developed between said inspection heads and respective individual closures for accepting or rejecting such respective closures;

said one or more nests including ejection apertures for permitting entry of pressurized fluid; and said means for accepting or rejecting said closures including one or more nozzles for selectively applying a stream of pressurized fluid through said ejection aperture for selectively ejecting acceptable closures from said nest.

21. Apparatus for automatically inspecting closures of the type having concave interior portions, corrugated edges and resilient plastic sealing liners from the outputs of a plurality of lining machines, comprising:

(a) a plurality of take-off and transport mechanisms for receiving hot, lined closures from respecting ones of said plurality of respective lining machines and transporting said closures to cooling means;

(b) cooling means for receiving said closures from said transport mechanisms, cooling said closures to a predetermined temperature range for testing, and distributing said closures among a plurality of transversely spaced apart rows for presentation to an inspection station; and (c) an inspection station for receiving said closures from said cooling means, said inspection station including at least one inspection head located at said inspection station, said inspection head having a ring of sawtooth-shaped projections corresponding in size and circumferential distribution to the corrugated edge of acceptable closures and engageable in mating relation therewith, the shape of said inspection head adapted to allow formation of a fluid tight seal with the interior of said closures at the sealing liner only when the projections of the inspection head mate with the corrugated edge of an acceptable closure, said fluid tight seal being capable of withstanding a predetermined positive pressure so as to test said closures for proper shape and seal, and ejecting acceptable closures onto an accepted closure path.

22. Apparatus according to claim 21 wherein at least one of said take-off mechanisms comprises a non-magnetic belt conveyor disposed over one or more strips of magnetized material.

23. Apparatus according to claim 22 wherein said takeoff mechanism includes preliminary inspection means for detecting and rejecting defective closures likely to jam subsequent mechanisms in said apparatus.

24. Apparatus according to claim 23 wherein said preliminary inspection means comprises photoelectric means for detecting closures or clusters of closures exceeding a predetermined height.

25. Apparatus according to claim 22 wherein said takeoff mechanism includes jam detection means for detecting jamming of said closures and shutting off said liner machine in response to detection of such a jam.

26. Apparatus according to claim 25 wherein said jam detection means comprises a triggered gate for opening under pressure.

27. Apparatus according to claim 21 wherein at least one of said transport mechanisms comprises an air track comprising, on at least three sides, a track for a single closure and a tubular manifold including a plurality of air passageways for directing streams of air in the direction of the track.

28. Apparatus according to claim 21 wherein said cooling means comprises a conveyor of mesh belting.

29. Apparatus according to claim 21 wherein said cooling means comprises a plurality of transversely spaced apart, longitudinally extending collimating walls for constraining said closures into a plurality of transversely spaced apart rows.

30. Apparatus according to claim 21 wherein said inspection station comprises:

a plurality of inspection nests for receiving respective individual such closures and retaining them during inspection;

means for supplying individual such closures to respective inspection nests;

a plurality of inspection heads shaped for insertion into the concave interior portions of said closures; and means for inserting said inspection heads into the concave interior portions of such closures into contact therewith and withdrawing said inspection heads from said closures.

31. Apparatus according to claim 30 including means for supplying pressurized fluid between said inspection heads and respective closures during contact therebetween.

32. Apparatus according to claim 30 wherein said plurality of inspection nests are arranged in an array of transversely spaced apart rows and longitudinally spaced apart columns.

33. Apparatus according to claim 30 further comprising means for moving said plurality of inspection nests beneath said plurality of inspection heads for inspection of closures included in successive columns of inspection nests.

34. Apparatus according to claim 33 wherein:

said means for moving said plurality of inspection nests includes movable conveyor means;

said plurality of inspection nests are arranged on said movable conveyor means in an array of transversely spaced apart rows and longitudinally spaced apart columns; and said plurality of inspection heads are arranged in one or more columns with the heads of each column transversely spaced apart by the transverse spacing between successive rows of inspection nests.

35. Apparatus according to claim 34 including means for heating said closures while they are on said conveyor means.

36. Apparatus for automatically inspecting closures of the type having concave interior portions and resilient plastic sealing liners from the outputs of a plurality of lining machines, comprising:

a plurality of take-off and transport mechanisms for receiving hot, lined closures from respective ones of said plurality of respective lining machines and transporting said closures to cooling means;

cooling means for receiving said closures from said transport mechanisms, cooling said closures to a predetermined temperature range for testing, and distributing said closures among a plurality of transversely spaced apart rows for presentation to an inspection station;

an inspection station for receiving said closures from said cooling means, testing said closures for proper shape and seal, and ejecting acceptable closures onto an accepted closure path; and said cooling means including one or more resilient bumper means disposed in the path of closures exiting from said transport mechanism for randomly transversely distributing said closures.

37. Apparatus according to claim 36 including isolation means for keeping separate the closures from different ones of such plurality of lining machines.

38. Apparatus according to claim 37 wherein said isolation means comprises a plurality of transversely spaced apart vertical walls disposed above said cooling conveyor for keeping separate the closures arriving at said cooling means from different lining machines.

39. Apparatus according to claim 37 further comprising:

a plurality of reject container means; and rejection means for delivering to each said reject container means the rejected closures from a respective lining machine.

40. Apparatus according to claim 37 further comprising:

a plurality of carbon loading means; and ejection means for delivering to each said carbon loading means the acceptable closures from a respective lining machine.

41. Apparatus for automatically inspecting closures of the type having concave interior portions and resilient plastic sealing liners from the outputs of a plurality of lining machines, comprising:

a plurality of take-off and transport mechanisms for receiving hot, lined closures from respective ones of said plurality of respective lining machines and transporting said closures to cooling means;

cooling means for receiving said closures from said transport mechanisms, cooling said closures to a predetermined temperature range for testing, and distributing said closures among a plurality of transversely spaced apart rows for presentation to an inspection station;

an inspection station for receiving said closures from said cooling means, testing said closures for proper shape and seal, and ejecting acceptable closures onto an accepted closure path;

said cooling means including a plurality of transversely spaced apart, longitudinally extending collimating walls for constraining said closures into a plurality of transversely spaced apart rows; and one or more agitator means for preventing jamming of closures by said collimating walls.

42. Apparatus according to claim 41 wherein said one or more agitator means comprises at least one rotatable resilient flail positioned transversely between a pair of adjacent collimating walls and longitudinally near the leading edges of said walls.

43. Apparatus for automatically inspecting closures of the type having concave interior portions and resilient plastic sealing liners from the outputs of a plurality of lining machines, comprising:

a plurality of take-off and transport mechanisms for receiving hot, lined closures from respective ones of said plurality of respective lining machines and transporting said closures to cooling means;

cooling means for receiving said closures from said transport mechanisms, cooling said closures to a predetermined temperature range for testing, and distributing said closures among a plurality of transversely spaced apart rows for presentation to an inspection station;

an inspection station for receiving said closures from said cooling means, testing said closures for proper shape and seal, and ejecting acceptable closures onto an accepted closure path; and said cooling means including means for transversely aligning said closures for presentation to said inspection station.

44. Apparatus according to claim 43 wherein said means for transversely aligning said closure comprises a transversely extending flexible gate.

45. Apparatus for automatically inspecting closures of the type having concave interior portions and resilient plastic sealing liners from the outputs of a plurality of lining machines, comprising:

a plurality of take-off and transport mechanisms for receiving hot, lined closures from respective ones of said plurality of respective lining machines and transporting said closures to cooling means;

cooling means for receiving said closures from said transport mechanisms, cooling said closures to a predetermined temperature range for testing, and distributing said closures among a plurality of transversely spaced apart rows for presentation to an inspection station;

an inspection station for receiving said closures from said cooling means, testing said closures for proper shape and seal, and ejecting acceptable closures onto an accepted closure path;

said inspection station including:

a plurality of inspection nests for receiving respective individual such closures and retaining them during inspection;

means for supplying individual such closures to respective inspection nests;

a plurality of inspection heads shaped for insertion into the concave interior portions of said closures;

means for inserting said inspection heads into the concave interior portions of such closures into contact therewith and withdrawing said inspection heads from said closures;

said each of said inspection nests include respective ejection apertures for permitting entry of air; and said means for ejecting acceptable closures onto an accepted closure path comprises means for selectively applying streams of pressurized air through said respective ejection apertures.

46. A method for inspecting shaped closures of the type having a concave interior portion, corrugated edges and a resilient plastic sealing liner and including the steps of serially feeding closures from a supply to an inspection station having at least one inspection head and then to output and rejection stations, inspecting the interior of each closure at the inspection station and determining the presence or absence of certain physical characteristics of the interior of the closure as included in an acceptable closure and ejecting acceptable closures at the output station and unacceptable closures at the rejection station, the improvement characterized in that:

(a) positioning each of the closures in said inspection station with the interior thereof in alignment with an inspection head, said inspection head having a ring of sawtooth-shaped projections corresponding in size and circumferential distribution to the corrugated edge of acceptable closures and engagable in mating relation therewith, the shape of said inspection head adapted to allow formation of a fluid tight seal with the interior of said closure at the sealing liner only when the projections of the inspection head mate with the corrugated edge of an acceptable closure, said fluid tight seal being capable of withstanding a predetermined positive pressure from said source of fluidized pressure;

(b) moving said inspection head into the interior of the closure until movement thereof is obstructed by the structure of the interior and with the projections of the inspection head mating with the corrugated edge of the closure and the head in fluid tight sealed relation with the sealing liner if the closure is an acceptable one;

(c) supplying fluidized pressure from said source to the interior of the closure at a level which is no greater than said predetermined pressure and less than that required to break the seal between the inspection head and sealing liner when the seal is created with an acceptable closure but greater than that required to break any seal formed with an unacceptable closure;

(d) sensing the pressure developed in the closures; and (e) ejecting the accepted closures at the output station and the unacceptable closures at the rejection station in response to sensing of the pressure developed in said closures.

* * * * *